United States Patent [19]

Palum

[11] 4,095,409

[45] Jun. 20, 1978

[54] CHIMING MECHANISM

[75] Inventor: Barry L. Palum, Rochester, N.Y.

[73] Assignee: Marine Midland Bank of Rochester, Rochester, N.Y.

[21] Appl. No.: 493,582

[22] Filed: Aug. 1, 1974

Related U.S. Application Data

[63] Continuation of Ser. No. 369,672, Jun. 13, 1973, abandoned.

[51] Int. Cl.[2] ..... G04B 121/06

[52] U.S. Cl. ..... 58/13; 84/404; 116/169

[58] Field of Search ..... 58/8–13, 58/1–2, 7; 84/102–103, 403–407; 116/160, 164, 165, 167, 169, 172

[56] References Cited

U.S. PATENT DOCUMENTS

| | | | |
|---|---|---|---|
| 220,227 | 10/1879 | Fiske | 58/8 |
| 372,849 | 11/1887 | Harrington | 84/103 |
| 538,306 | 4/1895 | Westerfield | 58/16 R |
| 699,303 | 5/1902 | Fox | 58/13 |
| 717,865 | 1/1903 | Juhlin | 116/172 |
| 759,619 | 5/1904 | Korfhage | 58/13 |
| 936,352 | 10/1909 | Petrillo | 58/10 |
| 1,267,989 | 5/1918 | Demuth | 58/2 |
| 1,398,972 | 12/1921 | Little | 58/38 A |
| 3,077,138 | 2/1963 | Vaughn et al. | 84/407 X |

FOREIGN PATENT DOCUMENTS

| | | | |
|---|---|---|---|
| 665,513 | 9/1929 | France | 58/13 |
| 938 of | 1852 | United Kingdom | 58/8 |

OTHER PUBLICATIONS

W. I. Milham, "Time and Timekeepers", The Macmillan Company, New York, 1923, pp. 294–295, 316–317.

*Primary Examiner*—Lawrence R. Franklin
*Attorney, Agent, or Firm*—Martin LuKacher

[57] ABSTRACT

A chiming clock having tube chimes for sounding the quarter hours and striking the hours contains a striking, quarter chiming and timing mechanism wherein the music barrel or rotary element of the chiming train may be located substantially in any position with respect to the chimes by reason of the use of cords which are extended over pulleys so as to define the desired path for translation of the rotary movement of the music barrel or striking train rotary elements into percussive movement of plungers against the chimes.

6 Claims, 5 Drawing Figures

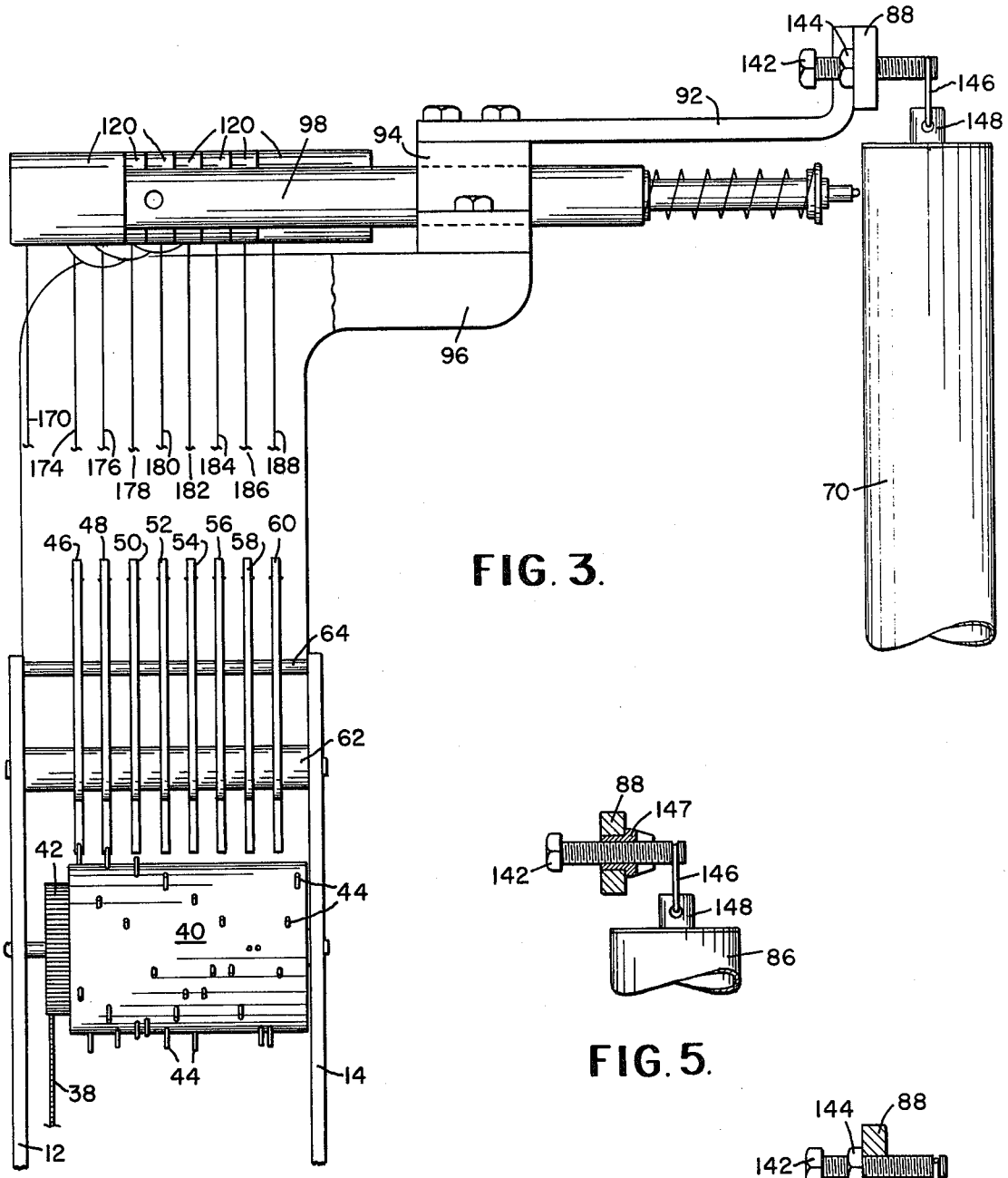
FIG. 3.
FIG. 5.
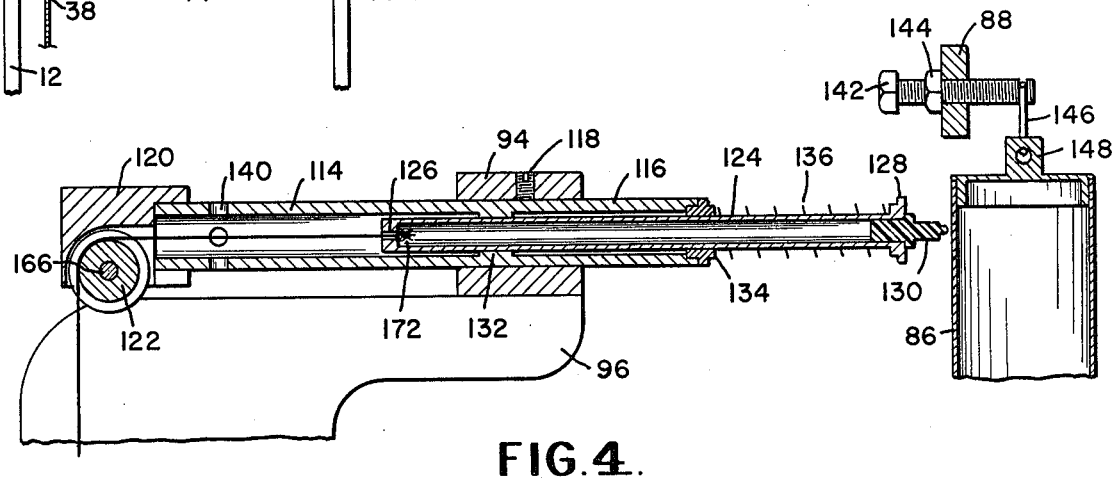
FIG. 4.

CHIMING MECHANISM

This is a continuation of application Ser. No. 369,672, filed 6/13/73, now abandoned.

The present invention relates to chiming mechanisms and particularly to clock movements having chiming mechanisms.

The invention is especially suitable for use in clock movements having a plurality of chime tubes for striking the hours and sounding the quarter hours, such clock movements being embodied in the so-called "grandfather clocks". Clock movements and chiming mechanisms in accordance with the invention may also find application in other devices for sounding chimes of various types such as rod or bell chimes as well as tube chimes.

Although various forms of electromagnetically operative chiming mechanisms have been recently suggested, mechanically operated chiming mechanisms have remained of substantially the same design for many decades and perhaps as long as two centuries. All such classical designs are characterized by having chime music cylinders or barrels with pins which lift hammers. As the hammers are lifted and then released they strike the chimes. The chime tubes are oriented with their axes perpendicular to the axes of the chime barrel so that the hammers can be lifted by the pins on the barrel as it rotates (see for example U.S. Pat. No. 699,303 of May 6, 1902). Inasmuch as the chimes for esthetic and practical reasons of convenience in mounting are usually disposed to the rear of the clock movement, the axis of the chime barrel is perpendicular to the axes of the arbors of the gear train in the clock movement. The classical chiming mechanisms therefore, require the use of right-angle gearing such as beveled gears, or combinations of spur gears and crown gears for translating the motion of the clock movement and operating the chiming mechanism. These right-angle gear drives are also known by the name of "contrite gears or gearing". It has been found in accordance with a feature of this invention that such contrite gearing may be eliminated, thus removing the constraints on the design of clock movements which resulted therefrom and lowering the cost of manufacture of such movements, while at the same time increasing the efficiency of transfer and conversion of clock drive power into percussion at the chimes.

Accordingly, it is a principal object of the present invention to provide improved chiming mechanisms.

It is another object of the present invention to provide improved clock movements for chiming clocks.

It is a further object of the present invention to provide improved chiming mechanisms in which contrite gears are eliminated.

It is a still further object of the present invention to provide an improved chiming clock mechanism wherein the chimes may be located wherever desired to accommodate the esthetic and/or mechanical design constraints for the clock movement.

It is a still further object of the present invention to provide an improved chiming clock having tube chimes wherein contrite gearing is eliminated.

It is a still further object of the present invention to provide an improved chiming mechanism in which the efficiency of transmission and conversion of mechanical power into percussion at the chimes is improved.

It is a still further object of the present invention to provide an improved chiming mechanism for chiming clocks and the like which can be more readily manufactured and at lower cost than classical chiming clock movements.

Briefly described, a chiming mechanism embodying the invention translates the rotational movement of a rotary element, such as a chime music barrel, into percussion against the chime. The mechanism includes a cord which is entrained over one or more pulleys. The pulleys define a path for the cord between the rotary element and the chime. When the rotary element is operated, as when it is released periodically by the time mechanism of the clock, the cord is pulled and then released. The cord is tied at its end to a plunger or striker which may have a spring which is compressed when the cord is pulled. When the cord is released the spring drives the plunger into percussion with the chime, thus sounding the chime.

The aforementioned and other objects and advantages and features of the present invention will become more readily apparent from a reading of the following description in connection with the accompanying drawings in which:

FIG. 3 is an end view of the mechanism illustrated in FIG. 1;

FIG. 4 is a fragmentary sectional view, the section being taken along the line 4—4 in FIG. 1, showing a plunger and a chime of the mechanism in greater detail; and FIG. 5 is a fragmentary sectional view of the adjustable chime hanging mechanism, similar to that shown in FIG. 4.

Figure 1:
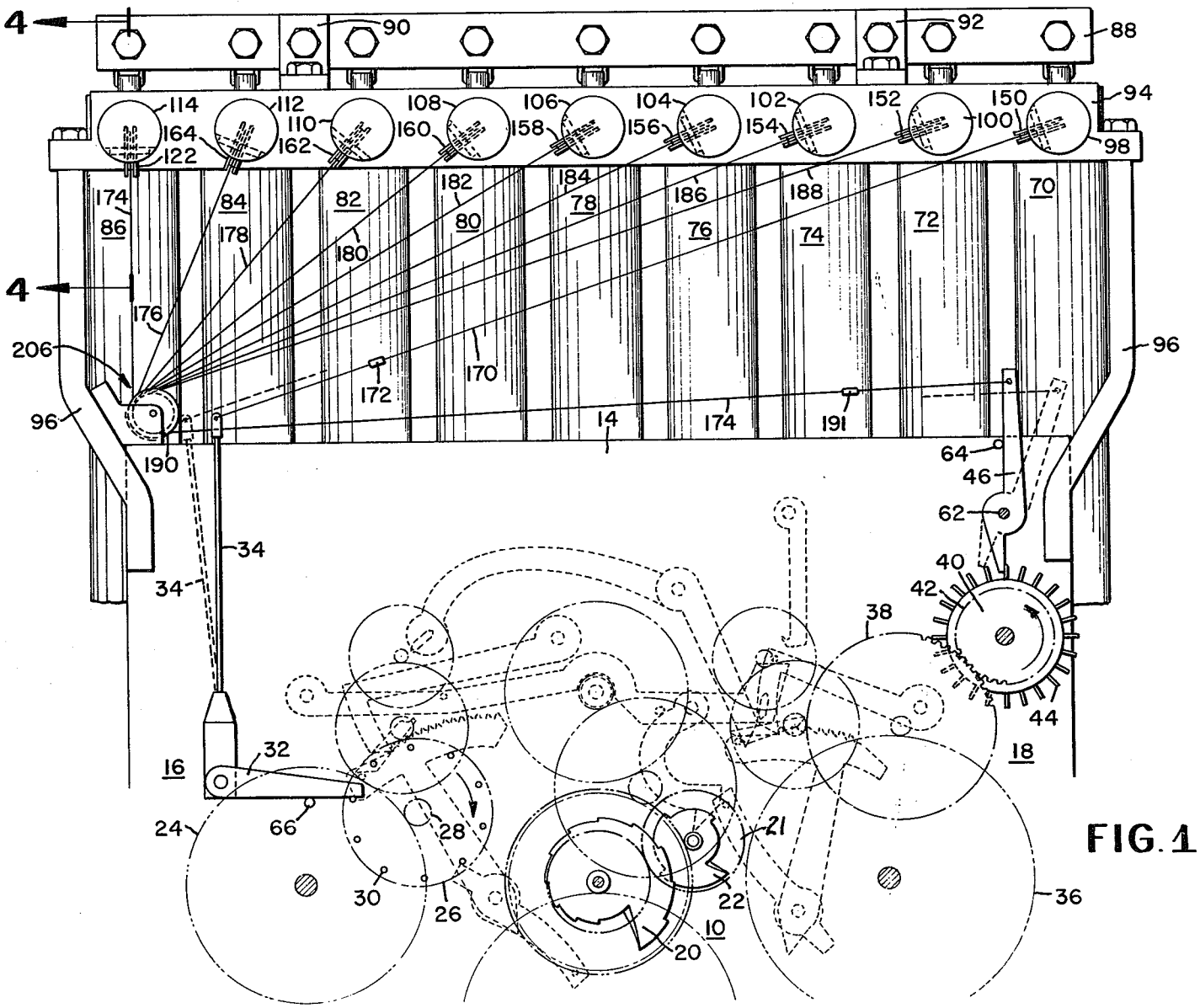
FIG. 1 is a front view of a clock movement provided with a chiming mechanism, all in accordance with the invention.
Figure 2:
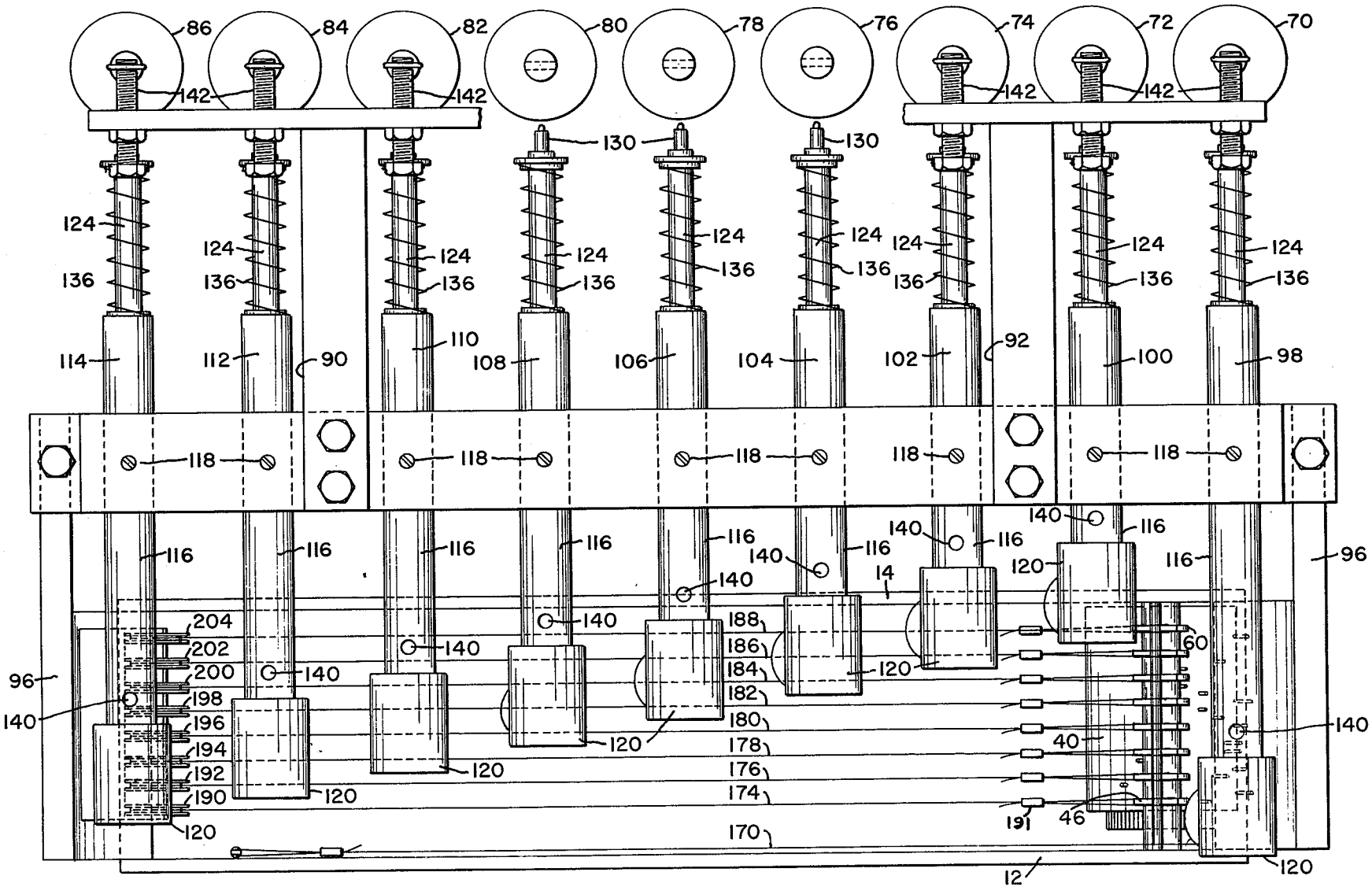
FIG. 2 is a plan view of the mechanism illustrated in FIG. 1.

Referring more particularly to the drawings, the time train 10 of the time mechanism of the clock movement consists of a number of gears mounted on arbors which extend between the plates 12 and 14 of the clock movement. The gears of the striking train 16 and the chime train 18 are similarly mounted between the plates 12 and 14. The striking train 16 and the chime train 18 are periodically released, as by detents on the minute wheel 21 with which turns the snails 20 and 22, and which index the chiming and striking trains 16 and 18 when the hours are to be struck and/or the quarter hours sounded. Inasmuch as the design of the time mechanism 10 and of the striking train 16 and chime train 18 may be conventional, it is not described in detail herein. Like the gears of the time mechanism, the gears in the striking train 16 and chime train 18 have arbors extending between the plates 12 and 14; the arbors all being parallel to each other.

The main wheel 24 of the striking train 16 has the cord of the striking weight wound around it. This main wheel 24 drives a second wheel 26 through a pinion 28. The second wheel 26 is a rotary element which effects the striking of the hours. Pins 30 circumferentially arranged around the rotary element 26 lift a striking lever 32. The lever 32 is lifted and released by one pin for striking the hour of One, twice by two pins in sequence for striking the hour of Two, and so forth, depending upon the hour which has to be struck. The striking lever 32 is also pivotally mounted on an arbor which extends between the plates 12 and 14 and has an extension rod 34 which is connected for operating the chime which strikes the hours as will be explained in greater detail hereinafter.

The chiming train 18 has a cable barrel or drum 36 around which the cable from the chiming weight is wound. The drum 36 is released to rotate by the time mechanism 10. When the drum 36 is released, the chime main wheel rotates therewith and drives the chime sequencing mechanism so as to rotate the second wheel 38 of the chime train by indexed amounts depending upon whether the quarter hour, half hour, three-quarter hour or the hour chimes are to be sounded. The chime or music barrel 40 is driven by the second wheel 38 through a spur gear 42. The chime barrel 40 carries twenty-three rows of pins 44 which control the sequence of the sounding of the chime, and in this embodiment allow for triple chime selection. It will be noted that the arbor of the chime barrel is journalled in the front and rear plates 12 and 14 of the frame of the clock movement and is parallel to the arbors of the other gears in the time striking and chiming trains (i.e., their axes are all parallel to each other).

A bank of chime lifter levers 46, 48, 50, 52, 54, 56, 58 and 60 is provided. These levers are laterally offset from each other between the plates 12 and 14 and are mounted on an arbor 62 which extends between the plates 12 and 14. Each of the levers corresponds to a different set of three rows of pins 44 on the chime barrel 40. The levers 46 to 60 are lifted by the pins and moved to positions as shown by the dash lines just prior to their being released by the pins. A stop in the form of a rod 64 which also extends between the plates 12 and 14 determines the rest position of the levers 46 to 60. The rest position of the striking lever 32 is similarly determined by a stop which is provided by a rod 66. The position of the lever 32 and its extension 34 just prior to release by the pins 30 also being shown in dash lines.

The chimes are provided by 9 chime tubes, one tube 70 (for striking the hours) and tubes 72, 74, 76, 78, 80, 82, 84 and 86 for sounding the quarter hours in different sequences, depending upon the arrangement of pins on the chime or music barrel 40. These tubes are suspended from a chime hanger bar 88 at the rear of the clock movement (see FIG. 3). It will be appreciated of course that more or fewer chimes may be used in accordance with the invention and these chimes may be rods, bells, wire gongs, or tubes as shown. It will also be apparent as the description proceeds that the chimes need not necessarily be mounted at the rear of the clock movement (although this position is preferred for esthetic reasons in the case of grandfather clocks). The chime hanger 88 is connected by way of a pair of brackets 90 and 92 to a bar 94. The bar 94 is carried on and forms part of a rack assembly 96 which supports the chimes and plunger mechanisms 98, 100, 102, 104, 106, 108, 110, 112 and 114, upon the plates 12 and 14 of the clock movement frame.

The plunger mechanisms, as shown in FIG. 4, consist of plunger tubes 116 held in holes in the bar 94 by set screws 118. The tubes 116 are of different lengths. A cyclindrical cap 120 is mounted on the rear end of the tube by, for example, being force-fit thereon. The caps 120 are rotatable so as to provide for the correct angular disposition of pulleys (the pulley 122 in the case of the plunger mechanism 114 shown in FIG. 4) which are mounted rotation in their respective caps. A striker or plunger 124 is mounted for movement into and out of the front end of the tube 116. The plunger 124 is a tube which is closed at its rear end 126. A flange 128 is formed in the front end of the plunger. An impactor in the form of a plastic, say nylon, insert 130 is force-fit into the open end of the plunger 124. The plunger is guided by a bushing surface 132 interior of the tube 116, and another bushing 134 which is force-fit or otherwise fastened at the open end of the tube 116.

A coil spring 136 has its first and last coil located in slots in the flange 128 and in the bushing 134. This spring 136 biases the plunger 124 towards the chime. It will be noted that the plunger mechanism is located adjacent to the chime in each case. The stiffness of the spring 136 is selected in consonance with the mass of the plunger 124 so that the plunger 124 will be moving at maximum velocity at the instant it strikes the chime adjacent thereto. In other words, the distance travelled by the spring between its compressed position and the position where it strikes the chime, is the distance over which it must travel to acquire maximum velocity. The curve defining the velocity of the plunger as a function of distance is a sinusoid which reaches a maximum value for the travel distance between the position of the plunger where the spring is compressed and the position of the plunger at impact with the chime. By selecting the mass of the plunger and the stiffness and mass of the spring, this velocity is maximized. The foregoing is a feature of the invention which provides for increased efficiency of power transmission from the weight which is the source of the power to percussion at the chimes (viz., conversion from rotary to percussive power).

The tube 116 has holes 140 which allow the ingress and egress of air such that there is no interference due to the compression of air by the plunger 124 as it moves in the tube 116.

Inasmuch as the caps 120 which contain the pulleys are in different laterally offset positions, they appear in side-by-side relationship in FIG. 3.

The chimes themselves are adjustably hung from bolts 142 which extend through holes in the hanger bar 88 (see FIGS. 3–5). The bolts 142 may be locked in place by nuts 144. Alternatively, threaded bushings 147 may be located in the hanger bars 88 (see FIG. 5). The ends of the bolts 144 have slots in which loops of cord 146 are located. These loops extend through either U-shaped wires which are held in discs which cap the upper end of the chime tubes (viz., the tube 70 in FIG. 3 or the tube 86 as shown in FIGS. 4 and 5). Alternatively, and as shown, these discs at the upper ends of the chime tubes may have bosses 148 extending therefrom. The loops 146 are then threaded through the bosses to hang the chimes. By adjusting the lateral position of the chime tubes 70 to 86 through the use of the bolts 142 and nut 144 or bushing 147 mechanisms, the impact position of the plungers 124 and the chimes 70 to 86 may be exactly adjusted so as to locate the impact position at the maximum velocity position of the plunger. In this way the efficiencies resulting from having the plunger obtain maximum velocity, as discussed above, will be obtained.

In addition to the pulley 122 in the cap 120 of plunger mechanism 114, the caps 120 of each of the other plunger mechanisms each has a pulley journalled therein. Thus plunger mechanism 98 has a pulley 150; the plunger mechanism 100 has a pulley 152; the plunger mechanism 102 has a pulley 154; the plunger mechanism 104 has a pulley 156; the plunger mechanism 106 has a pulley 158; the plunger mechanism 108 has a pulley 160; the plunger mechanism 110 has a pulley 162; and the plunger mechanism 112 has a pulley 164.

The arbor or axis of each of these pulleys such as the arbor 166 of the pulley 122 (see FIG. 4) is offset from the axis of the tube 116 of its respective plunger mechanism. The pulley 150 defines a path for a cord 170 which translates the motion of the rotary element 26 of the striking train 16 into percussion of the plunger mechanism 98 against the chime 70. This cord 170 is tied at one end to the end of the extension rod 34 of lever 32, and at the other end to the rear of the plunger of plunger mechanism 98. As shown in FIG. 4, the cord connection may be obtained by threading the cord through a hole 172. With the insert 130 removed, a knot is tied in the end of the cord so as to prevent it from passing back through the hole 172. By virtue of the offset relationship of the arbor 166, the cord extends along the axis of the tube 116, around the pulley (in this case the pulley 150) and along the path to the rod 34 of the lever 32 which is actuated by the rotary element 26 of the striking train 16. The cord 170 is therefore located along the path defined by the pulley 150 between the rotary element 26 and the chime 70. Inasmuch as the cap 120 (FIG. 4) is rotationally adjustable about the axis of the tube 116, the path of the cord 170 will run true so that the cord 170 will not tend to fall off the pulley 150. The pulleys are grooved and the cap 120 acts as a fender to maintain the cord on the pulley. The proper length of the cord 170 is provided by means of a sleeve 173 of soft metal in which a loop of the cord 170 may be formed. The sleeve 173 is then crimped so as to take up any slack in the cord. This also maintains the tension on the cord when it is pulled to actuate the plunger mechanism. The cord 170, as is the case for the other cords in the chime mechanism described herein, may be braided line of the type used in fishing equipment. The type of fishing line known as monofilament is not preferred.

Translation of the rotary movement of the chime barrel 40 into percussion of the plunger mechanisms 100 to 114 against the chimes 72 to 86 is provided by means of cords 174, 176, 178, 180, 182, 184, 186 and 188. Each of these cords is entrained around a separate pulley 190, 192, 194, 196, 198, 200, 202, and 204 in a pulley bank 206. These pulleys are mounted in a block 207 which acts as a fender to prevent the cords from leaving the pulley grooves. The cords 174 to 188 extend in a plurality of directions between the chime barrel 40 and the chimes 70 to 86. More particularly, each of the eight lifting levers 46 to 60 corresponds to a different one of the pulleys 190 to 204 in the pulley bank 206 and to a different one of the pulleys 122 and 152 to 164 in the caps 120 of the plunger mechanisms 98 to 114; the lever 46 corresponding to the pulley 190 and to the pulley 122, for example. Each of the corresponding levers and pulleys are correspondingly laterally offset from each other such that the cords therebetween lie in the same plane between the plates 12 and 14 of the frame of the clock mechanism. Also the path defined by the cords 174 to 188 form angles which increase in size or number of degrees depending upon the distance which the plunger mechanisms and their corresponding chimes are offset from the chime barrel 40.

It will be appreciated that the feature of the invention which provides for the use of cords entrained around pulleys allows the paths of the cords to be located almost wherever desired in accordance with the esthetic and/or mechanical design constraints applicable to any particular chiming mechanism or clock movement. The chimes may be located in groups either in the rear of the movement as shown, the front of the movement, or at the sides of the movement. The chimes may even be hidden. Notwithstanding the location of the chimes or their arrangement in groups, the cords provide for the proper translation of the rotary movement which powers the chimes and converts that rotary movement into percussion for sounding the chimes. The requisite length of and tension in the cords may be provided by crimping sleeve 191 similar to the sleeve 173 described in connection with the cord 170.

In operation as a lever, either the lever 32 or any of the levers 46 to 60, is lifted and then released, the springs 136 of their respective plunger mechanisms will be compressed and then released, causing percussion at the chimes such that the chimes will be sounded. The use of the cord, pulleys, and plunger mechanisms thus affords a convenience of assembly as well as efficiency of operation, and flexibility of the design.

From the foregoing description it will be apparent that there has been provided an improved clock mechanism and also an improved chime mechanism. Although a clock mechanism containing the improved chime mechanism which is of the type used in weight-operated clocks has been described herein, it will be appreciated that the chime mechanism and the clock movement associated therewith may be incorporated, in accordance with the invention, in other types of clocks and chiming machines. Where screws and fasteners have been shown they have been indicated as being of the Allenhead type. Of course, other types of fasteners may be used, as well as other variations and modifications, all within the spirit and scope of the invention.

The foregoing description, being merely illustrative, should not be taken as restricting the scope of the invention or otherwise in any limiting sense.

What is claimed is:

1. A chiming mechanism adapted for use in a clock of the grandfather type and the like having clock works and the multiplicity of tube chimes in side-by-side relationship adjacent to the clock works such that said chimes and clock works can be contained within the confines of said clock, said mechanism comprising:

(a) a rotatable member providing a source of driving power for striking said chimes, (b) a chime music barrel having its axis parallel to the axis of said rotatable member and coupled thereto in direct driving relationship therewith such that said chime music barrel is sequentially rotationally movable under control of said clock works, said chime music barrel having an axial length much smaller than the lateral distance across said multiplicity of chimes, and (c) apparatus for translating the rotational movements of said chime music barrel into percussion against the chimes, said apparatus comprising:

(i) cords, (ii) a plurality of pulleys defining separate paths for said cord between said chime music barrel and said chimes, said paths each having a plurality of linear portions and each being defined by a plurality of said pulleys, said paths each also extending in a plurality of directions between said chime barrel and said chimes, (iii) means connected to said cords at one end thereof and operated by said chime music barrel for actuating said cords in response to the rotational movements of said chime music barrel, said actuating means and said pulleys defining one of said plurality of linear portions, (iv) means connected to said cords at the opposite ends thereof for striking said chimes, said striking means and said pulleys defining another one of said plurality of linear portions, said another of said linear portions being perpendicular to the axis of said chimes such that the driving power is delivered directly to said chimes by said striking means; and (d) said chimes being disposed with their longitudinal axes in a plane perpendicular to the axis of said chime music barrel and wherein in each of said paths, a first of said plurality of pulleys has its axis parallel to said chime barrel axis and the second of said plurality of pulleys has its axis in a plane parallel to the plane in which said chimes are disposed, said one path portion being disposed between said actuating means and said first of said plurality of pulleys, said another one of said plurality of path portions being disposed between said second of said plurality of pulleys and said striking means, and a third of said path portions being disposed between said first and second pulleys.

2. The invention as set forth in claim 1 wherein said one and said third path portions of said cords form angles of decreasing size with locations of said second pulleys at increasing distances from said first pulleys towards said chime music barrel.

3. In a clock of the grandfather type and the like, a chiming mechanism for striking a plurality of tube chimes arranged in a bank within the confines of said clock, said chiming mechanism comprising:

(a) a plurality of spring actuated strikers, each disposed adjacent a different one of said plurality of chimes, (b) a plurality of levers corresponding to a different one of said plurality of strikers, (c) a rotatable chime actuator, disposed adjacent to said chimes and having an axial length much smaller than the lateral distance across said bank, and having means for lifting said levers, (d) a plurality of cords each connected directly between a different one of said plurality of levers and its corresponding striker for actuating said strikers, (e) a plurality of pulleys for defining a plurality of paths having a plurality of linear portions extending across said bank of chimes and towards said chimes and translating movement of said levers to said strikers regardless of the relative position of said strikers and said chime actuator; and (f) said pulleys being arranged in two groups, the pulleys of a first of said two groups being disposed adjacent to said strikers, and the pulleys of the second of said two groups being disposed in laterally offset relationship with each other and on the same axis, the pulleys of said first group each having their axis angularly offset with respect to each other, said first group pulleys also having their axis in laterally offset relationship corresponding to the lateral offset relationship of said second group pulleys so that the path of said cords between each lever and the one of the first group pulleys adjacent to the striker corresponding thereto lies in the same plane.

4. The invention as set forth in claim 3 wherein said strikers each comprise a tube, a plunger mounted in said tube and movable out of one end of said tube for striking the chime adjacent thereto, a cap on the opposite end of said tube rotatably adjustable about the axis of said tube, said cap having one of said first group pulleys rotatably mounted therein with its axis perpendicular to said cap axis so that rotation of said cap rotates the axis of the pulley therein.

5. The invention as set forth in claim 4 wherein the axis of the pulley mounted in said tube is offset in a radial direction from said cap axis so that said cord extends from said least named pulley axially of said tube to said plunger where the end of said cord is attached.

6. The invention as set forth in claim 5 where each of said strikers further comprises a coil spring disposed around the portion of said plunger which extends out of said one end of said tube.

* * * * *